US008950516B2

(12) United States Patent
Newman

(10) Patent No.: US 8,950,516 B2
(45) Date of Patent: Feb. 10, 2015

(54) BOREHOLE DRILL BIT CUTTER INDEXING

(75) Inventor: Cole Newman, Gunnison, UT (US)

(73) Assignee: US Synthetic Corporation, Orem, UT (US)

( * ) Notice: Subject to any disclaimer, the term of this patent is extended or adjusted under 35 U.S.C. 154(b) by 602 days.

(21) Appl. No.: 13/288,847

(22) Filed: Nov. 3, 2011

(65) Prior Publication Data

US 2013/0112480 A1 May 9, 2013

(51) Int. Cl.
*E21B 10/573* (2006.01)

(52) U.S. Cl.
CPC ..... *E21B 10/573* (2013.01)
USPC ..... 175/383; 175/381; 175/382

(58) Field of Classification Search
CPC ..... E21B 10/573
USPC ..... 175/26, 379, 381, 382, 383; 408/188; 407/7
See application file for complete search history.

(56) References Cited

U.S. PATENT DOCUMENTS

| | | | |
|---|---|---|---|
| 1,686,403 | A | 10/1928 | Boynton |
| 1,723,381 | A | 8/1929 | Seifert |
| 1,790,613 | A | 1/1931 | Gildersleeve et al. |
| 2,289,707 | A | 7/1942 | Hellman |
| 2,506,341 | A | 5/1950 | Bullock |
| 2,631,360 | A | 3/1953 | Sanford et al. |
| 2,710,180 | A | 6/1955 | Graham |
| 2,879,049 | A | 3/1959 | Poundstone |
| 2,917,819 | A | 12/1959 | Britton et al. |
| 3,136,615 | A | 6/1964 | Bovenkerk et al. |
| 3,141,746 | A | 7/1964 | De Lai |
| 3,271,080 | A | 9/1966 | Gowanlock |
| 3,528,516 | A | 9/1970 | Brown |
| 3,565,192 | A | 2/1971 | McLarty |
| 3,720,273 | A | 3/1973 | McKenry et al. |
| 3,749,190 | A | 7/1973 | Shipman |
| 3,763,492 | A | 10/1973 | Easton |
| 3,847,236 | A | 11/1974 | Coalson |
| 4,014,395 | A | 3/1977 | Pearson |
| 4,047,583 | A | 9/1977 | Dyer |
| 4,057,884 | A | 11/1977 | Suzuki |
| 4,073,354 | A | 2/1978 | Rowley et al. |
| 4,199,035 | A | 4/1980 | Thompson |

(Continued)

FOREIGN PATENT DOCUMENTS

| | | |
|---|---|---|
| WO | 8606990 | 12/1986 |
| WO | 2005021191 | 3/2005 |
| WO | 2007044791 | 4/2007 |

OTHER PUBLICATIONS

PCT/US2012/062432, Notification of Transmittal of the International Search Report and the Written Opinion of the International Searching Authority, or the Declaration, Apr. 22, 2013.

*Primary Examiner* — Nicole Coy
*Assistant Examiner* — Kristyn Hall
(74) *Attorney, Agent, or Firm* — Holland & Hart LLP

(57) ABSTRACT

For drill bit cutter indexing, a housing is disposed in a drill bit. An indexing cog is in physical communication with a cutter and interlocks with the housing in a first index position of a plurality of index positions in response to a first compressive load applied to the cutter. A motivator disengages the indexing cog from the housing and positions the indexing cog to interlock with the housing at an initial second index position in response to a removal of the compressive load from the cutter.

20 Claims, 14 Drawing Sheets

(56) References Cited

U.S. PATENT DOCUMENTS

| | | | |
|---|---|---|---|
| 4,200,159 | A | 4/1980 | Peschel et al. |
| 4,201,421 | A | 5/1980 | Den Besten et al. |
| 4,222,446 | A | 9/1980 | Vasek |
| 4,337,980 | A | 7/1982 | Krekeler |
| 4,350,215 | A | 9/1982 | Radtke |
| 4,386,669 | A | 6/1983 | Evans |
| 4,396,077 | A | 8/1983 | Radtke |
| 4,453,605 | A | 6/1984 | Short, Jr. |
| 4,466,498 | A | 8/1984 | Bardwell |
| 4,511,006 | A | 4/1985 | Grainger |
| 4,538,690 | A | 9/1985 | Short, Jr. |
| 4,553,615 | A | 11/1985 | Grainger |
| 4,654,947 | A | 4/1987 | Davis |
| 4,690,228 | A | 9/1987 | Voelz et al. |
| 4,694,918 | A | 9/1987 | Hall |
| 4,720,216 | A | 1/1988 | Smith |
| 4,751,972 | A | 6/1988 | Jones et al. |
| 4,782,903 | A | 11/1988 | Strange |
| 4,802,539 | A | 2/1989 | Hall et al. |
| 4,877,096 | A | 10/1989 | Tibbitts |
| 5,007,493 | A | 4/1991 | Coolidge et al. |
| 5,007,685 | A | 4/1991 | Beach et al. |
| 5,056,382 | A | 10/1991 | Clench |
| 5,181,576 | A | 1/1993 | Askew et al. |
| 5,279,375 | A | 1/1994 | Tibbitts et al. |
| 5,293,945 | A | 3/1994 | Rosenhauch et al. |
| 5,318,138 | A | 6/1994 | Dewey et al. |
| 5,332,051 | A | 7/1994 | Knowlton |
| 5,351,772 | A | 10/1994 | Smith |
| 5,469,927 | A | 11/1995 | Griffin |
| 5,558,170 | A | 9/1996 | Thigpen et al. |
| 5,678,645 | A | 10/1997 | Tibbitts et al. |
| 5,810,103 | A | 9/1998 | Torbet |
| 5,906,245 | A | 5/1999 | Tibbitts et al. |
| 5,947,214 | A | 9/1999 | Tibbitts et al. |
| 5,975,811 | A | 11/1999 | Briese |
| 6,070,677 | A | 6/2000 | Johnston, Jr. |
| 6,073,524 | A | 6/2000 | Weiss et al. |
| 6,283,234 | B1 | 9/2001 | Torbet |
| 6,302,224 | B1 | 10/2001 | Sherwood, Jr. |
| 6,408,959 | B2 | 6/2002 | Bertagnolli et al. |
| 6,655,479 | B2 | 12/2003 | Kleine et al. |
| 6,733,087 | B2 | 5/2004 | Hall et al. |
| 6,733,365 | B1 | 5/2004 | Shaw et al. |
| 7,048,080 | B2 | 5/2006 | Griffo et al. |
| 7,070,011 | B2 | 7/2006 | Sherwood, Jr. et al. |
| 7,192,226 | B2 | 3/2007 | Unsworth |
| 7,533,709 | B2 | 5/2009 | Meyer |
| 7,533,720 | B2 | 5/2009 | Robichaux et al. |
| 7,533,739 | B2 | 5/2009 | Cooley et al. |
| 7,604,073 | B2 | 10/2009 | Cooley et al. |
| 7,681,646 | B2 | 3/2010 | Robichaux et al. |
| 7,681,665 | B2 | 3/2010 | Eppink |
| 7,845,436 | B2 | 12/2010 | Cooley et al. |
| 7,882,905 | B2 | 2/2011 | Radford et al. |
| 7,913,760 | B2 | 3/2011 | Robichaux et al. |
| 7,987,931 | B2 | 8/2011 | Cooley et al. |
| 8,061,452 | B2 | 11/2011 | Cooley et al. |
| 8,079,431 | B1 | 12/2011 | Cooley et al. |
| 8,146,663 | B2 | 4/2012 | Robichaux et al. |
| 8,210,285 | B2 | 7/2012 | Cooley et al. |
| 8,297,348 | B2 | 10/2012 | Robichaux et al. |
| 8,528,631 | B2 | 9/2013 | Robichaux et al. |
| 8,561,728 | B2 | 10/2013 | Cooley et al. |
| 2002/0053472 | A1 | 5/2002 | Kleine et al. |
| 2005/0183892 | A1 | 8/2005 | Oldham et al. |
| 2007/0278017 | A1 | 12/2007 | Shen et al. |
| 2008/0017419 | A1* | 1/2008 | Cooley et al. ..... 175/286 |
| 2008/0085407 | A1 | 4/2008 | Cooley et al. |
| 2009/0020339 | A1 | 1/2009 | Sherwood, Jr. |
| 2010/0200298 | A1 | 8/2010 | Mackenzie |
| 2010/0314176 | A1 | 12/2010 | Zhang et al. |
| 2011/0088955 | A1 | 4/2011 | Cooley et al. |
| 2014/0020956 | A1 | 1/2014 | Cooley et al. |

* cited by examiner

BOREHOLE DRILL BIT CUTTER INDEXING

BACKGROUND

1. Field

The subject matter disclosed herein relates to borehole drill bit cutters and more particularly relates to borehole drill bit cutter indexing.

2. Description of the Related Art

The drill bits used to drill boreholes, particularly fixed cutter bits, employ cutters to fragment rock.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

References throughout this specification to features, advantages, or similar language do not imply that all of the features and advantages may be realized in any single embodiment. Rather, language referring to the features and advantages is understood to mean that a specific feature, advantage, or characteristic is included in at least one embodiment. Thus, discussion of the features and advantages, and similar language, throughout this specification may, but do not necessarily, refer to the same embodiment.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The schematic flowchart diagrams and/or schematic block diagrams in the Figures illustrate the architecture, functionality, and operation of possible implementations of apparatuses, systems, and methods according to various embodiments of the present invention. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only one embodiment of the functional flow.

Figure 1:
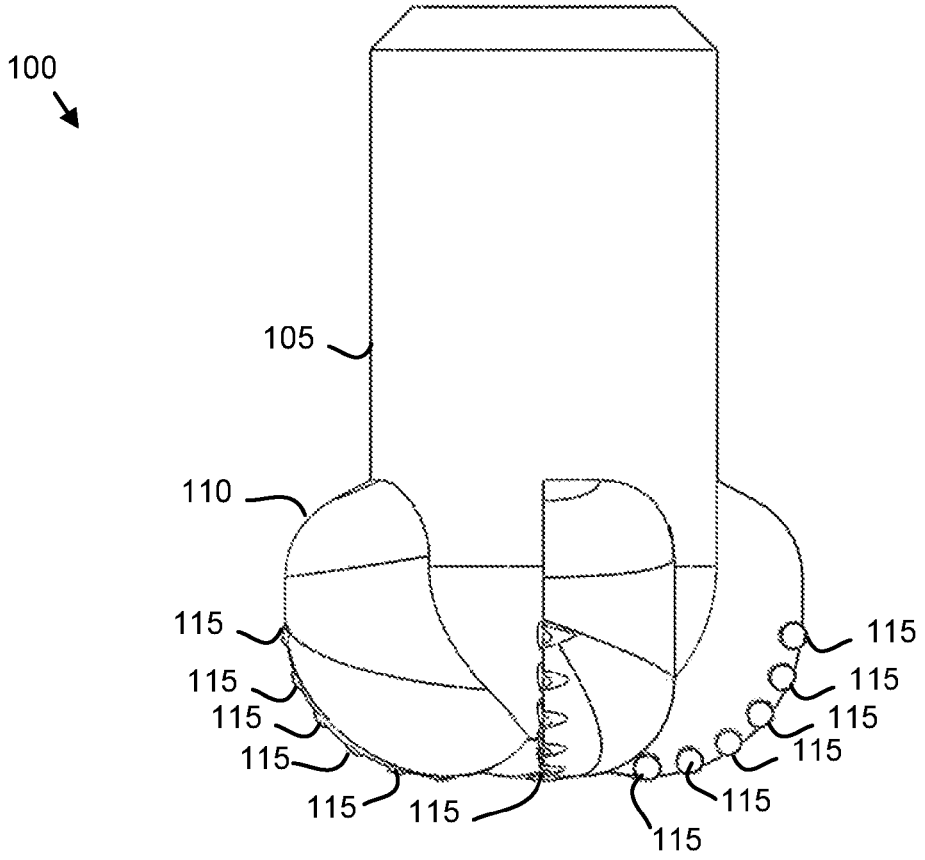
FIG. 1 is a side-view drawing illustrating one embodiment of a borehole drill bit.

FIG. 1 is a side-view drawing illustrating one embodiment of a borehole drill bit 100. In the depicted embodiment, the drill bit 100 is a fixed cutter drill bit 100, such as a polycrystalline diamond compact (PDC) or a grit hot pressed inserts (GHI) drill bit. Alternatively, the drill bit 100 may be a roller cone drill bit.

The drill bit 100 includes a shaft 105 and a head 110. A plurality of cutters 115 is disposed about the head 110. For clarity, only representative cutters 115 are labeled. In one embodiment, the cutters 115 grind against the rock interface during the drilling operation to fragment the rock.

Figure 2:
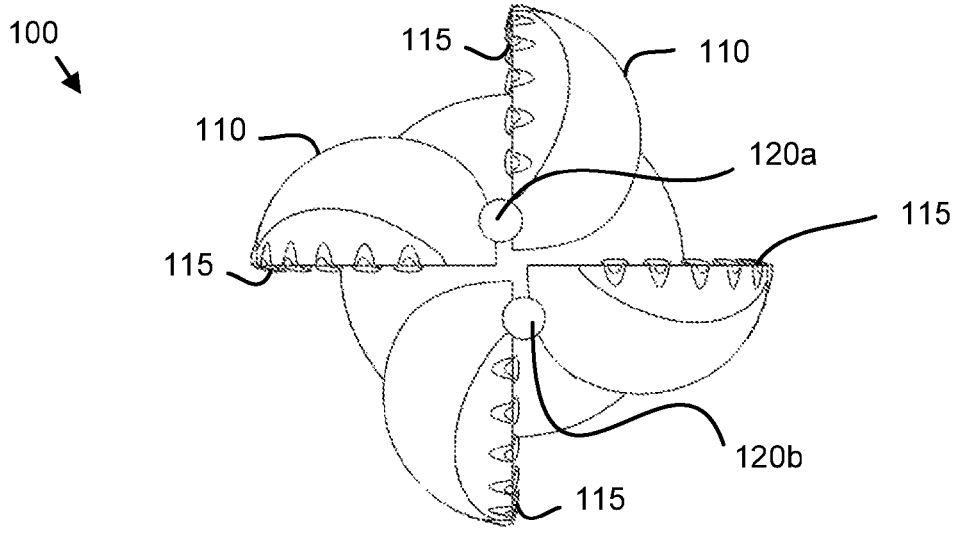
FIG. 2 is a bottom-view drawing illustrating one embodiment of a borehole drill bit.

FIG. 2 is a bottom-view drawing illustrating one embodiment of the drill bit 100. The drill bit 100 is a drill bit 100 of FIG. 1. The description of the drill bit 100 refers to elements of FIG. 1, like numbers referring to like elements. The drill bit includes a plurality of cutters 115. For clarity, only representative cutters 115 are labeled. The drill bit 100 includes or more openings 120. At least one opening 120 allows drilling fluid or drilling mud to be pumped into the drilling interface while least one other opening 120 removes the drilling fluid from the drilling interface.

Figure 3:
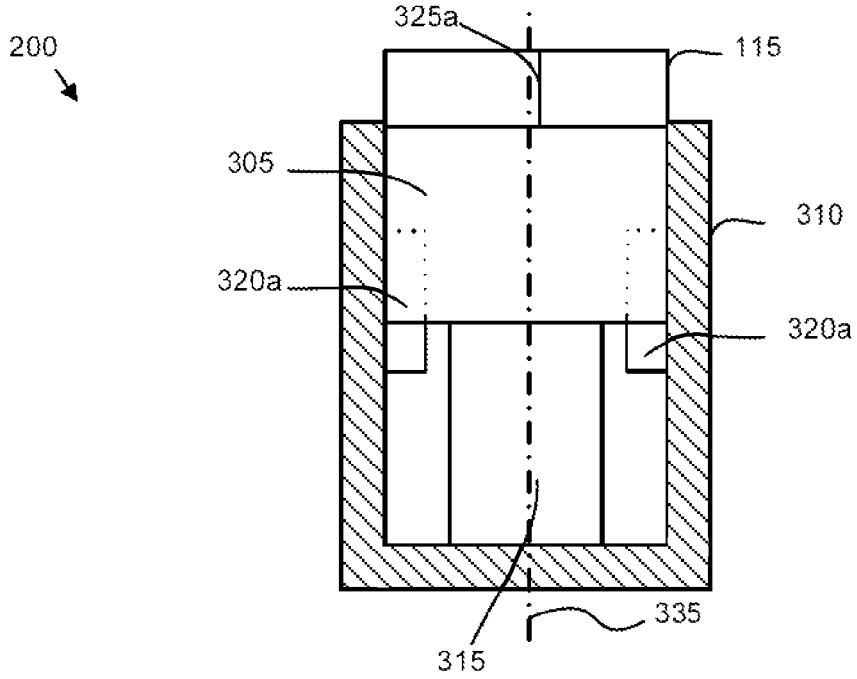
FIG. 3 is a partial cross-sectional view of one embodiment of a compressed indexing cutter apparatus.

FIG. 3 is a partial cross-sectional view of one embodiment of a compressed indexing cutter apparatus 200. The apparatus 200 may secure the cutter 115 within the drill bit 100. The description of the apparatus 200 refers to elements of FIGS.

1-2, like numbers referring to like elements. The apparatus 200 includes the cutter 115, a housing 310, an indexing cog 305, and a motivator 315. The apparatus 200 may also include a least one protrusion 320. In addition, a central axis 335 of the apparatus 200 is shown.

The housing 310 is disposed in the drill bit 100. The housing 310 may be integrated into the drill bit 100 in a cutter pocket (not shown). Alternatively, the housing 310 may be secured within the drill bit 100 by being press fit, using a mechanical locking mechanism, using a weld, or the like.

The indexing cog 305 is in physical communication with the cutter 115. The indexing cog 305 may be bonded, welded, mechanically fastened, or the like to the cutter 115. The indexing cog 305 interlocks with the housing 310 in a plurality of index positions that will be described hereafter. A different portion of the cutter 115 is primarily in contact with the rock in each index position.

If a portion of the cutter 115 is worn away during the drilling operation, the efficacy of the cutter 115 is diminished. In the past, when the efficacy of the cutters 115 on a drill bit 100 was sufficiently diminished, the drill bit 100 was raised to the surface and replaced. This replacement of the drill bit 100 is extremely costly to a drilling operation. The embodiments described herein index the cutter 115 to the new index position, exposing a new portion of the cutter 115 to the rock. As a result, the efficacy of the cutter 115 is maintained for a significantly longer time, resulting in substantial savings for the drilling operation.

In the depicted embodiment, a first index position 325*a* is indicated with a line. The protrusions 320 may secure the indexing cog 305 in the first index position 325*a*. In one embodiment, the protrusions 320 interlock with the indexing cog 305 to secure the indexing cog 305 to the housing 310 in each index position 325. In one embodiment, the index cog 305 comprises teeth that interlock with one or more edges of the protrusion 320. Alternatively, the protrusion 320 may fit within a slot of the indexing cog 305 in a tongue and groove manner to interlock the index cog 305 with the housing 310. In a certain embodiment, the protrusion 320 is disposed on the index cog 305 and interlocks with a groove of the housing 310. One of skill in the art will recognize that embodiments may also be practiced with slots, indentations, and fasteners interlocking with the indexing cog 305 to secure the indexing cog 305 to the housing 310.

The motivator 315 may attempt to disengage the indexing cog 305 from the housing 310. However, while compressive load is applied to the cutter 115 and overcomes the force of the motivator 315, the indexing cog 305 is securely interlocked with the housing 310, preventing the indexing cog 305 from indexing from the first indexing position 325*a* to another indexing position 325. The motivator 315 may include one or more springs, a pneumatic actuator, a hydraulic actuator, an electrical actuator, a piezoelectric actuator, a thermal actuator, or the like.

Figure 4:
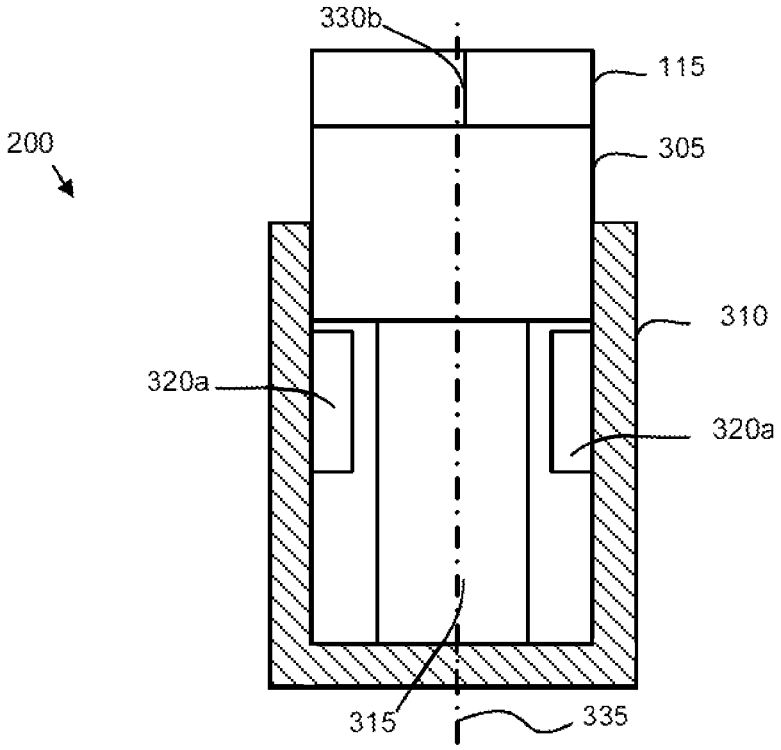
FIG. 4 is a partial cross-sectional view of one embodiment of an uncompressed indexing cutter apparatus.

FIG. 4 is a partial cross-sectional view of one embodiment of an uncompressed indexing cutter apparatus 200. The apparatus 200 of FIG. 3 is shown after the compressive load on the cutter 115 is removed. In one embodiment, the compressive load is removed when the drill bit 100 is lifted away from the rock interface in the borehole. The description of the apparatus 200 refers to elements of FIGS. 1-3, like numbers referring to like elements.

With the compressive load on the cutter 115 removed, the motivator 315 disengages the indexing cog 305 from the housing 310. In addition, the motivator 315 positions the indexing cog 305 to interlock with the housing 310 at an initial second index position 330*b*. In one embodiment, the initial second index position 330*b* is offset from the first index position 325*a* at an offset angle about the central axis 335. The offset angle may be in the range of 0.5° to 5°. In one embodiment, when the compressive force is reapplied to the cutter 115 in the initial second index position 330*b*, the indexing cog 305 is positioned to interlock with the housing 310 in a second index position in response to the compressive force as will be described hereafter. In a certain embodiment, the initial second index position 330*b* is the second index position.

Figure 5:
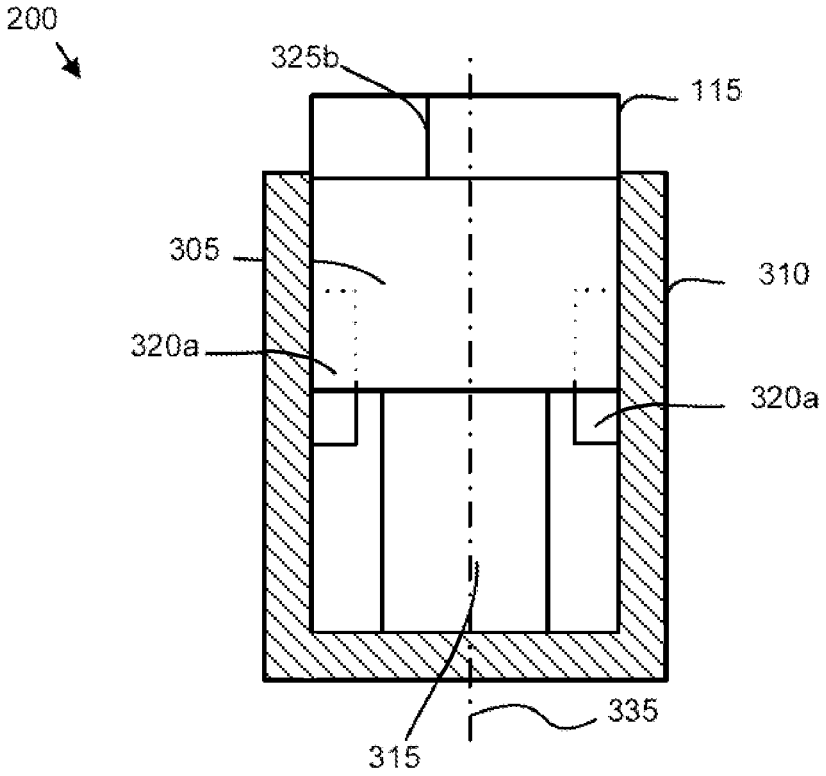
FIG. 5 is a partial cross-sectional view of one embodiment of a recompressed indexing cutter apparatus.

FIG. 5 is a partial cross-sectional view of one embodiment of a recompressed indexing cutter apparatus 200. The apparatus 200 is the apparatus 200 of FIG. 4 after the compressive load is reapplied to the cutter 115. In one embodiment, the compressive force is reapplied as the drill bit 100 is lowered against the rock interface in the borehole. The description of the apparatus 200 refers to elements of FIGS. 1-4, like numbers referring to like elements.

The compressive load of the drill bit 100 against the rock interface is reapplied to the cutter 115 as a second compressive load. The second compressive load pushes against and overcomes the force of the motivator 315, motivating the indexing cog 305 to interlock with the housing 310 in the second index position 325*b*. As a result, a new portion of the cutter 115 contacts the rock interface. By indexing the cutter 115 and presented a new portion of the cutter 115 to the rock interface, the drill bit 100 may continue drilling operations with high efficacy, without removing the drill bit 100 from the borehole.

Figure 6:
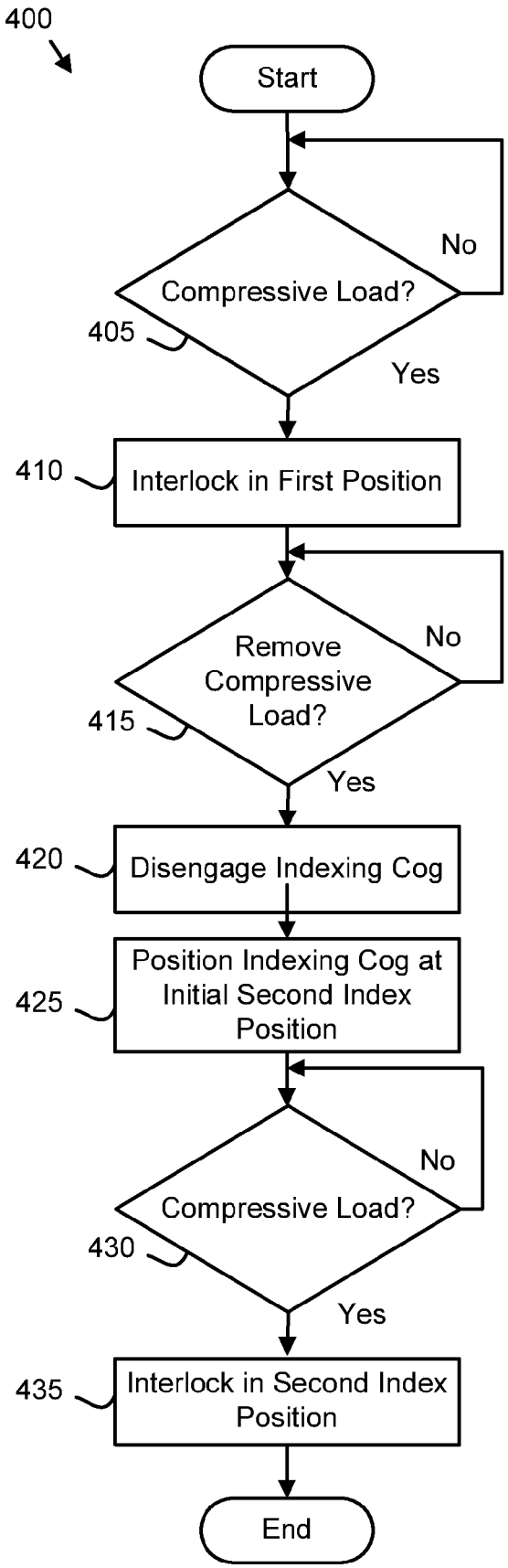
FIG. 6 is a schematic flow chart diagram illustrating one embodiment of a cutter indexing method.

FIG. 6 is a schematic flow chart diagram illustrating one embodiment of a cutter indexing method 400. The method 400 may perform the functions of the apparatus 200 of FIGS. 3-5. The description of the method 400 refers to elements of FIGS. 1-5, like numbers referring to like elements.

The method 400 starts, and in one embodiment a compressive load is not applied to the cutter 115. In one embodiment, the indexing cog 305 is positioned in an initial first index position. The indexing cog 305 may continue in the initial first index position until the compressive load is applied 405 to the cutter 115.

When the compressive load is applied 405 to the cutter, the compressive load pushes against the force of the motivator 315 and interlocks 410 the indexing cog 305 with the housing 310 in the first index position 325*a*. The indexing cog 305 is held 415 in the first index position 325*a* by the housing 310 until the compressive load is removed 415.

When the compressive load is removed 415, the motivator 315 disengages 420 the indexing cog 305 from the housing 310. In addition, the motivator 315 may position 425 the indexing cog 305 at the initial second index position 330*b*. In one embodiment, the indexing caught 305 remains 430 in the initial second index position 330*b* until the compressive load is applied to the cutter 115. When the compressive load is applied 430 to the cutter 115 as a second compressive load, the indexing cog 305 interlocks with the housing 310 in the second index position 325*b* in response to the compressive load applied to the cutter 115 and the method 400 ends. In one embodiment, the interaction of the indexing cog 305 and the protrusion 320 guide the indexing cog 305 to the second index position 330*b* in response to the compressive load.

The method 400 indexes the cutter 115 from the first index position 325*a* to the second index position 325*b* by removing 415 the compressive load on the cutter 115 and then reapplying 430 the compressive load to the cutter 115. As a result, the drill bit 100 may remain in the borehole much longer than without indexing of the cutter 115. A drilling operation need only briefly disengage the drill bit 100 from the rock interface to index the cutter 115. Thus each cutter 115 maybe repeatedly indexed while in the borehole to display a fresh portion of the cutter 115 to the rock interface.

Figure 7:
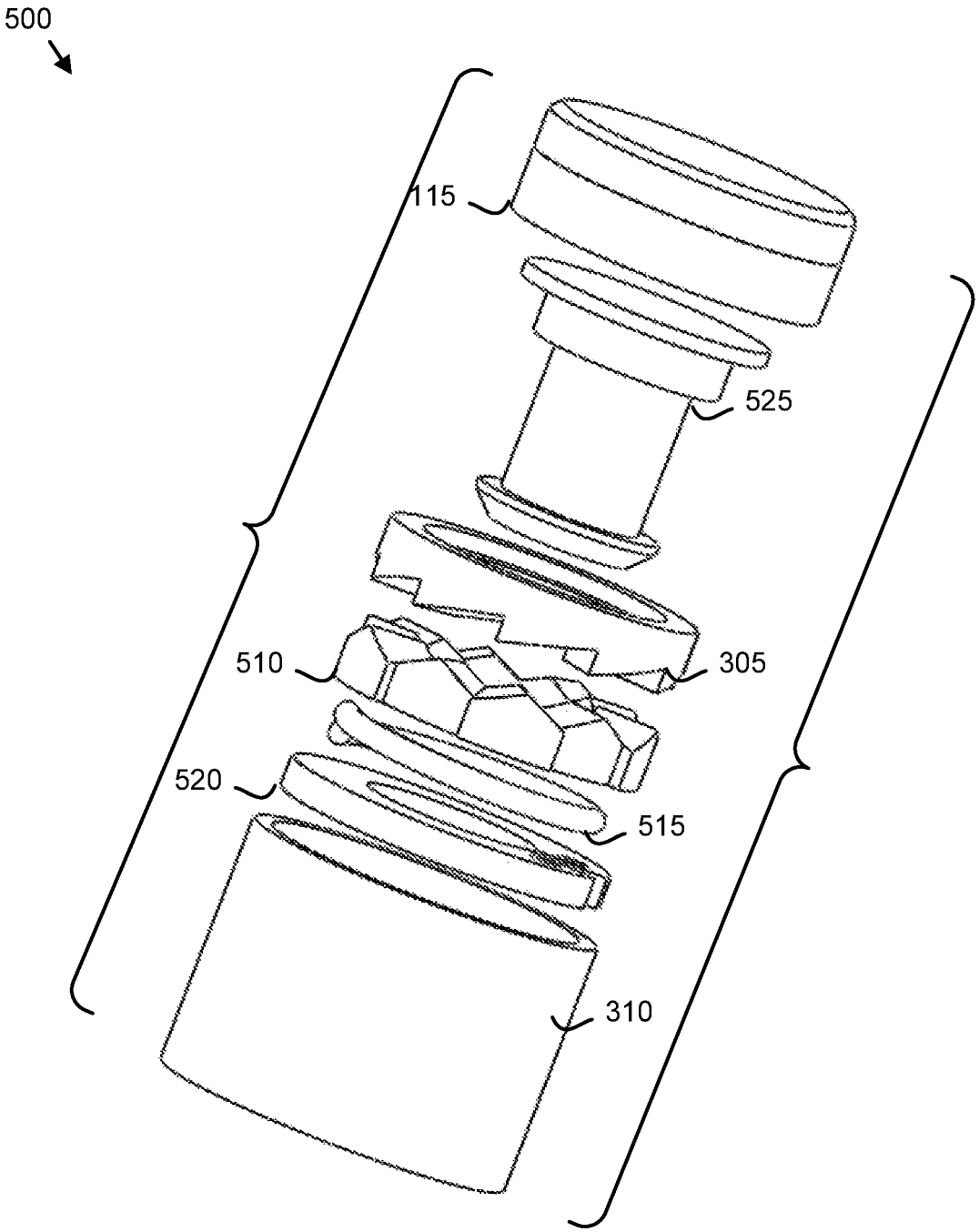
FIG. 7 is an exploded perspective view drawing illustrating one embodiment of an indexing cutter apparatus.

FIG. 7 is an exploded side-view drawing illustrating one embodiment of an indexing cutter apparatus 500. The apparatus 500 may be a species of the apparatus 200 of FIGS. 3-5. The description of the apparatus 500 refers to elements of FIGS. 1-6, like numbers referring to like elements. The apparatus 500 includes the cutter 115, the indexing cog 305, a stud 525, a push cog 510, a motivator spring 515, the locking ring 520, and the housing 310.

The cutter 115 is physically connected to the indexing cog 305. The cutter 115 may be physically connected to the indexing cog 305 via a bond, a fastener, a weld, and the like. The stud 525, push cog 510, motivator spring 515, and locking ring 520 may be embodied in the motivator 315. The stud 525 may be physically connected to the indexing cog 305. The stud 525 may be physically connected to the indexing cog 305 via a bond, a fastener, a weld, and the like. The locking ring 520 may secure the stud 525 to the housing 310 as will be shown hereafter.

Figure 8A:
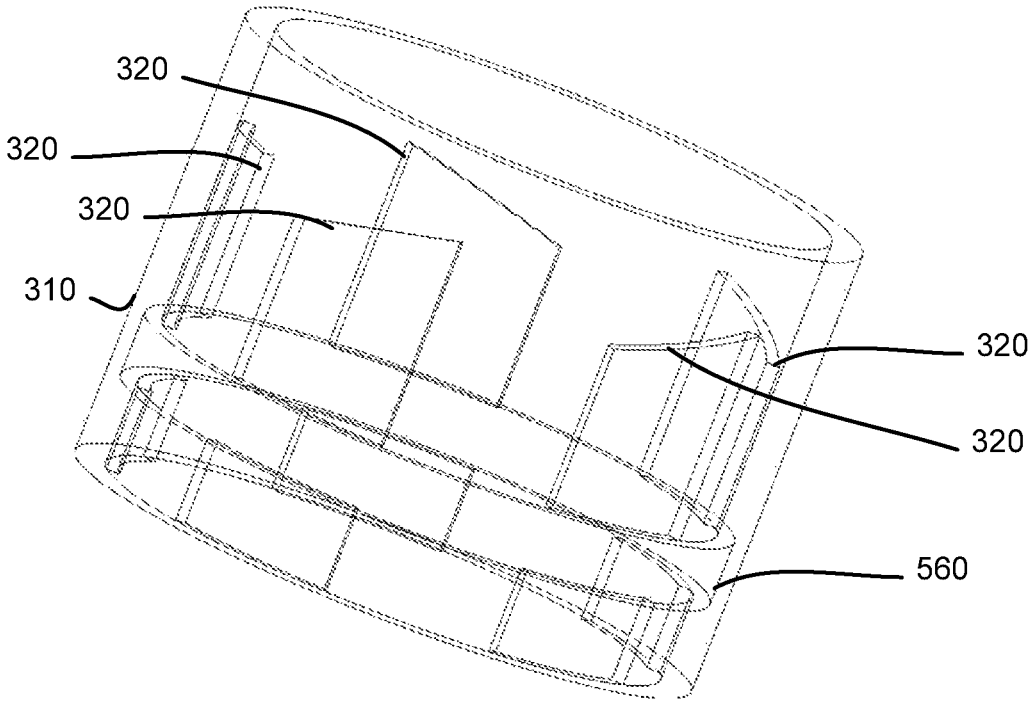
FIG. 8A is a perspective hidden-line drawing illustrating one embodiment of a housing.

FIG. 8A is a perspective hidden-line drawing illustrating one embodiment of a housing 310. The housing 310 is the housing 310 of FIG. 7. The description of the housing 310 refers to elements of FIGS. 1-7, like numbers referring to like elements. The housing 310 includes a plurality of protrusions 320 and a locking ring slot 560.

The protrusions 320 include a sloped top that interlocks with the indexing cog 305 as will be described hereafter. The locking ring slot 560 receives the locking ring 520 as will be described hereafter.

Figure 8B:
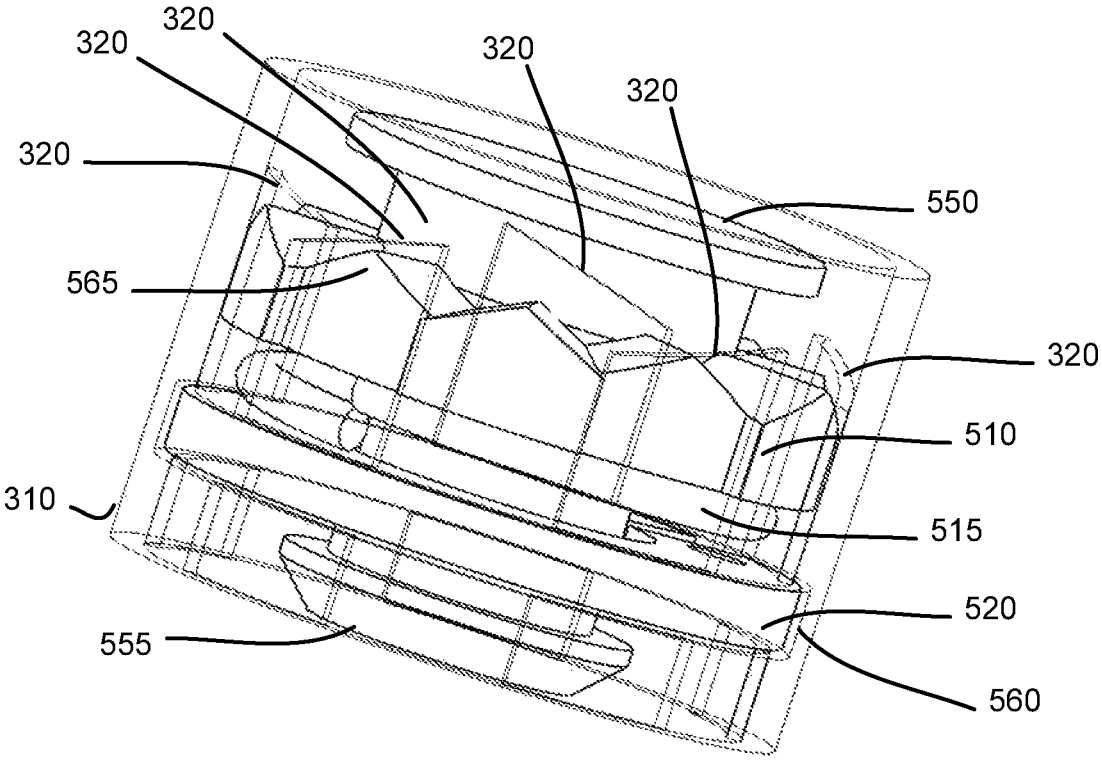
FIG. 8B is a perspective hidden-line drawing illustrating one embodiment of portions of the assembled indexing cutter apparatus.

FIG. 8B is a perspective drawing illustrating portions of the assembled indexing cutter apparatus 500. The apparatus 500 is the apparatus 500 of FIG. 7. The description of the apparatus 500 refers to elements of FIGS. 1-8A, like numbers referring to like elements.

The stud 525 includes a proximal end 550 and a distal end 555. The proximal end 550 may be physically connected to the indexing cog 305. The distal end 555 may be inserted through the push cog 510, the motivator spring 515, and the locking ring 520. In one embodiment, the locking ring 520 is compressed to a smaller diameter and fitted into the locking ring slot 560 of the housing 310. The locking ring 520 expands to fit within the locking ring slot 560, physically connecting the stud 525 to the housing 310 by securing the distal end 555 of the stud 525.

The motivator spring 515 may apply a force to the push cog 510. The force of the motivator spring 515 against the push cog 510 may attempt to disengage the indexing cog 305 from the housing 310. The push cog 510 may include a plurality of teeth. In one embodiment, at least one tooth 565 of the push cog 510 pushes against the indexing cog 305. For clarity, only a representative push cog tooth 565 is labeled.

Figure 9A:
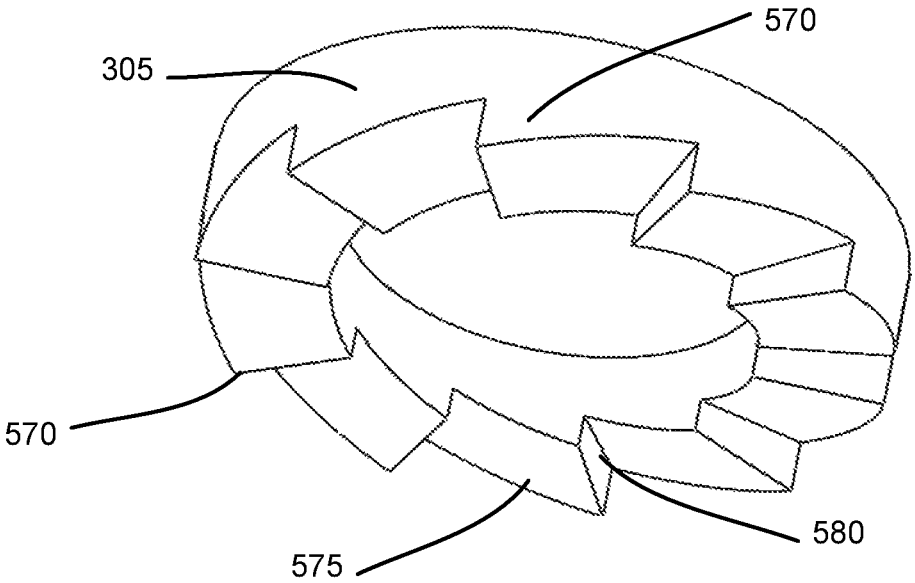
FIG. 9A is a perspective drawing illustrating one embodiment of an indexing cog.

FIG. 9A is a perspective drawing illustrating one embodiment of the indexing cog 305. The indexing cog 305 is the indexing cog 305 of FIG. 7. The description of the indexing cog 305 refers to elements of FIGS. 1-8, like numbers referring to like elements.

The indexing cog 305 may comprise a plurality of indexing cog teeth 570. For clarity, only representative indexing cog teeth 570 are labeled. At least one indexing cog tooth 570 may interlock with at least one protrusion 320 of the housing 310 in each of the plurality of index positions 325 as will be shown hereafter. In one embodiment, each indexing cog tooth 570 comprises a sloped face 575 and a vertical face 580.

When the compressive load is removed from the cutter 115, the force of the motivator spring 515 against the push cog 510 may push a push cog tooth 565 against a sloped face 575 of the indexing cog 305, disengaging the indexing cog 305 from the protrusions 320 of the housing 310. In addition, the force of the push cog tooth 565 against the sloped face 575 also generates a moment about the central axis 335, motivating the indexing cog 305 from the first index position 325*a* to the initial second index position 330*b*.

Figure 9B:
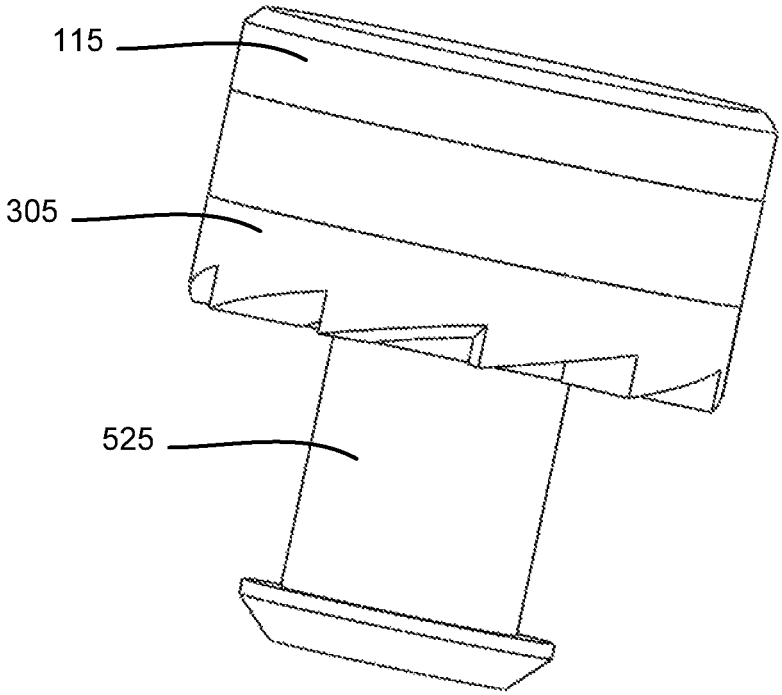
FIG. 9B is a perspective drawing illustrating one embodiment of portions of the assembled indexing cutter apparatus.

FIG. 9B is a perspective hidden-line drawing illustrating portions of the assembled indexing cutter apparatus 500. The apparatus 500 is the apparatus 500 of FIG. 7. The description of the apparatus 500 refers to elements of FIGS. 1-9A, like numbers referring to like elements. The proximal end 550 of the stud 525 is physically connected to the indexing cog 305. The physical connection may be a bond, a weld, a mechanical fastener, or the like. The indexing cog 305 is physically connected to the cutter 115. The physical connection may be a bond, a weld, a mechanical fastener, or the like.

Figure 10A:
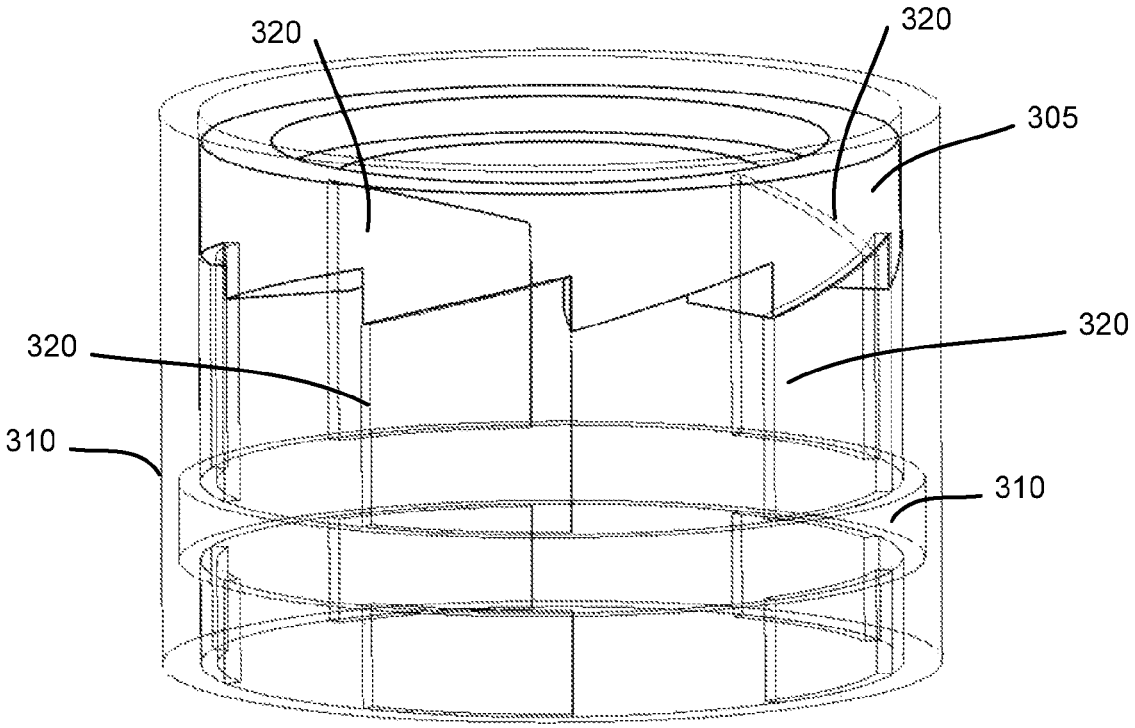
FIG. 10A is a perspective drawing illustrating one embodiment of an indexing cog interlocking with a housing.

FIG. 10A is a perspective drawing illustrating the indexing cog 305 interlocking with the housing 310. The indexing cog 305 and the housing 310 are the indexing cog 305 and housing 310 of FIG. 7. The description of the indexing cog 305 interlocking with the housing 310 refers to elements of FIGS. 1-9B, like numbers referring to like elements. For clarity, other components are not shown.

The housing 310 includes at least one protrusion 320. The protrusion 320 may be disposed along a cylinder wall of the housing. The space between the protrusions 320 may function as a channel to guide the push cog 510. In the depicted embodiment, each protrusion 320 has a sloped face that interlocks with the sloped face 575 of an indexing cog tooth 570. One of skill in art will recognize that embodiments may be practiced with other configurations of the protrusions 320 and the indexing cog 305 such that the indexing cog 305 interlocks with at least one protrusion 320.

Figure 10B:
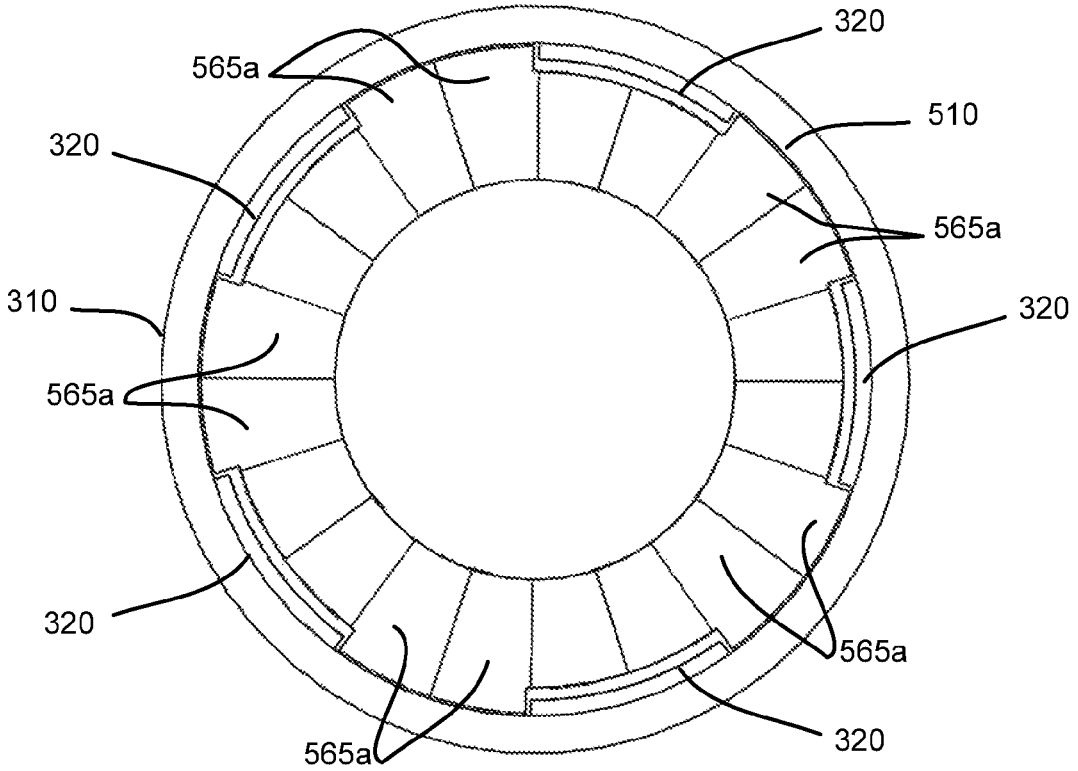
FIG. 10B is a top-view drawing illustrating one embodiment of a push cog interlocking with a housing.

FIG. 10B is a top-view drawing illustrating a push cog 510 interlocking with a housing 310. The push cog 510 and the housing 310 are the push cog 510 and housing 310 of FIG. 7. The description of the push cog 510 interlocking with the housing 310 refers to elements of FIGS. 1-10A, like numbers referring to like elements.

In the depicted embodiment, specified push cog teeth 565*a* of the push cog 510 fit in the space between the protrusions 320 of the housing, preventing the push cog 510 from rotating within the housing 310 and guiding the push cog 510 towards the indexing cog 305. Alternatively, other tongue and groove, guide and rail, or the like structures may be employed to prevent the push cog 510 from rotating in the housing 310 and to guide the push cog 510. In a certain embodiment, the housing 310 has a non-circular cross-section and the push cog 510 has a complementary non-circular cross-section.

Figure 11:
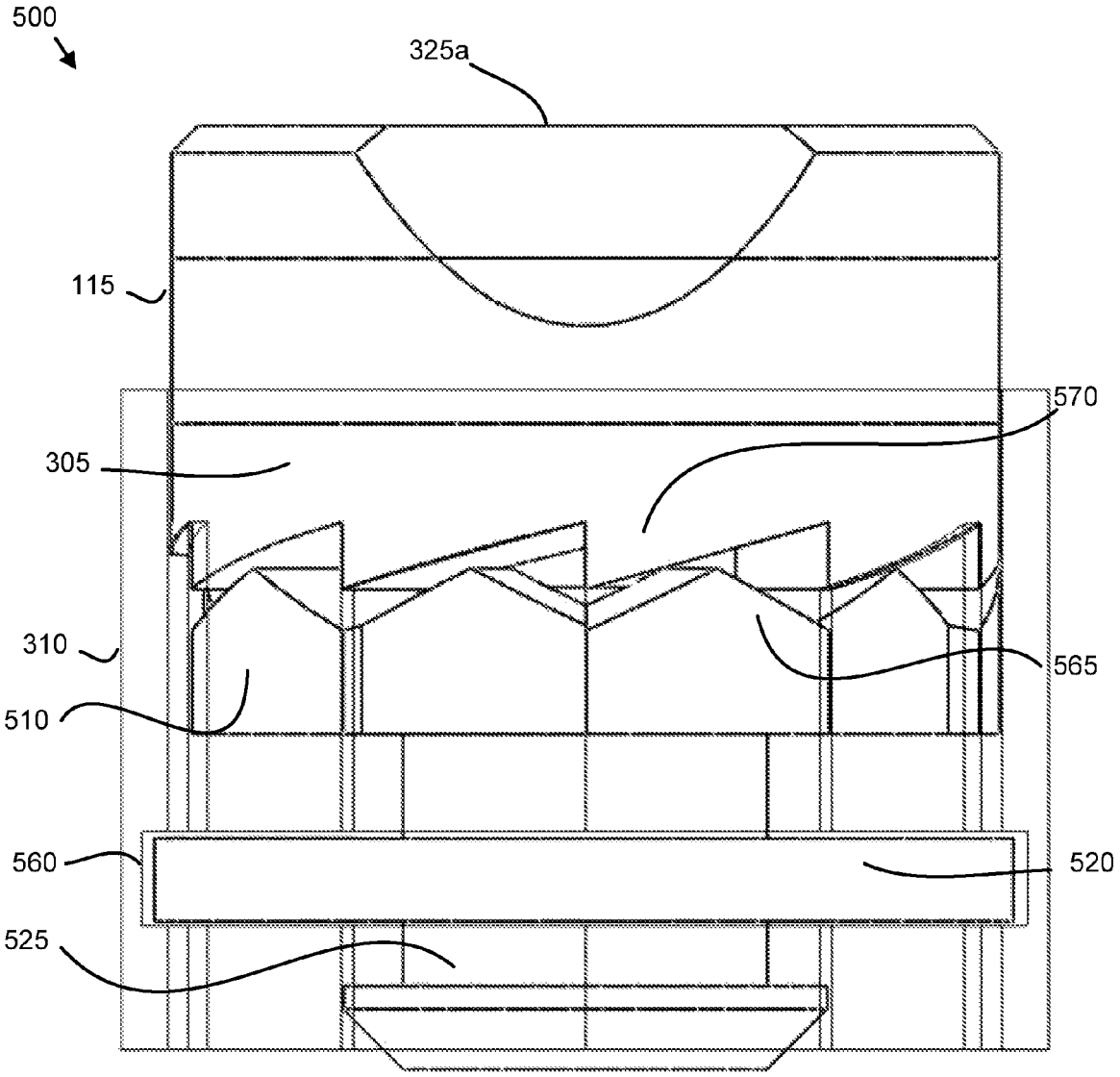
FIG. 11 is a side-view hidden-line drawing illustrating one embodiment of a compressed indexing cutter apparatus.

FIG. 11 is a side-view hidden-line drawing illustrating one embodiment of a compressed indexing cutter apparatus 500. The apparatus 500 may be the apparatus 500 of FIG. 7. The description of the apparatus 500 refers to elements of FIGS. 1-10, like numbers referring to like elements. The cutter 115 is shown in the first index position 325*a*. The compressive load prevents the motivator spring 515 (not shown for clarity) and the push cog 510 from disengaging the indexing cog 305 from the housing 310.

Figure 12:
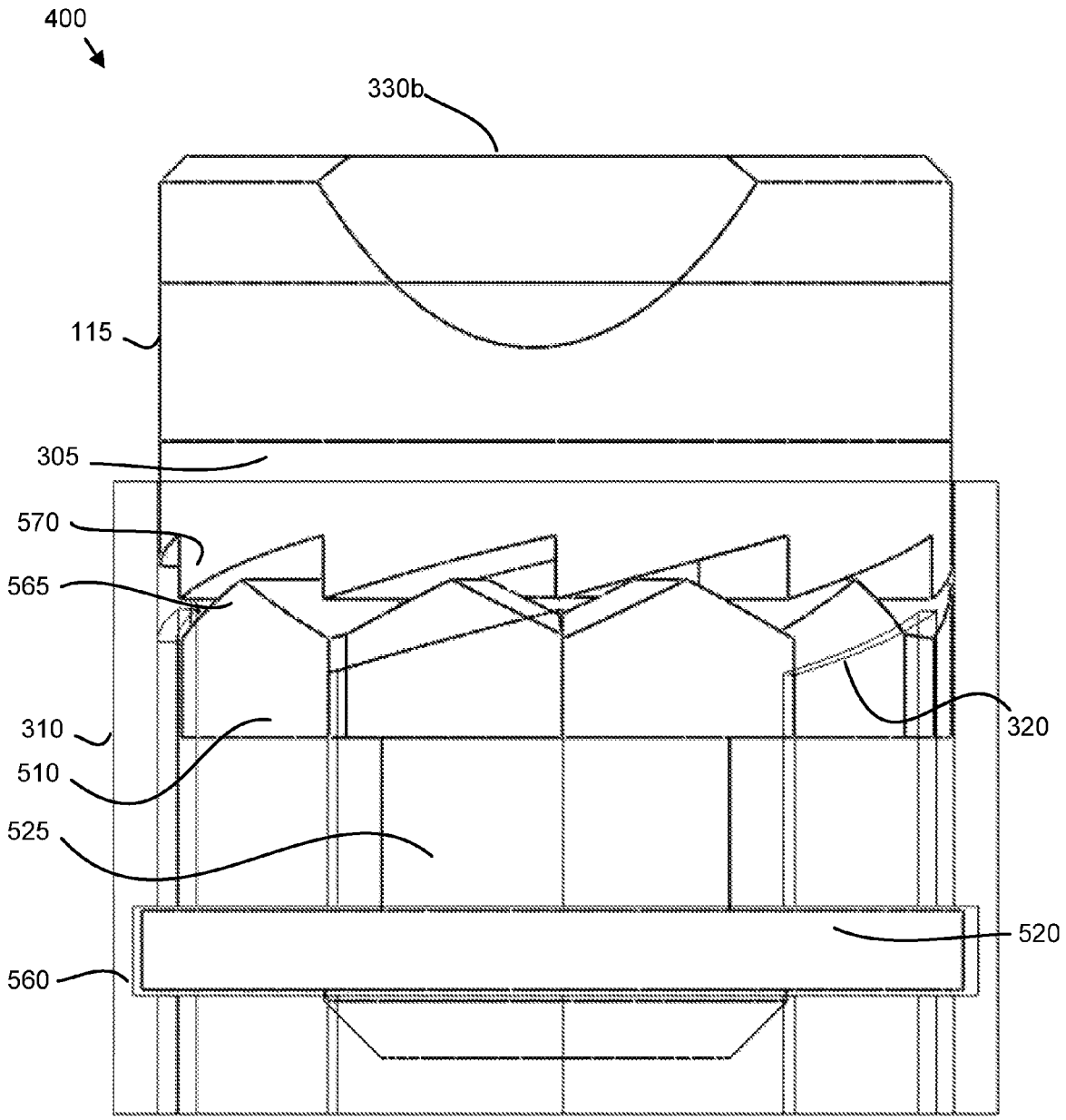
FIG. 12 is a side-view hidden-line drawing illustrating one embodiment of an uncompressed indexing cutter apparatus.

FIG. 12 is a side-view hidden-line drawing illustrating one embodiment of an uncompressed indexing cutter apparatus 500. The apparatus 500 may be the apparatus 500 of FIG. 11 with the compressive load removed. The description of the apparatus 500 refers to elements of FIGS. 1-11, like numbers referring to like elements. With the compressive load removed, the motivator spring 515 (not shown for clarity) has pushed the push cog 510 against the indexing cog 305.

Because there is no compressive load to counteract the motivator spring 515, the indexing cog 305 is disengaged from the protrusions 320 of the housing 310.

The cutter 115 is shown moved to the initial second index position 330*b*. In one embodiment, the initial second index position 330*b* is disposed so that the reapplication of the compressive load on the cutter 115 will push the sloped face 575 of at least one indexing cog tooth 570 to contact a protrusion 320 and guide the indexing cog 305 to interlock with a protrusion 320 in the second index position 325*b*.

Figure 13:
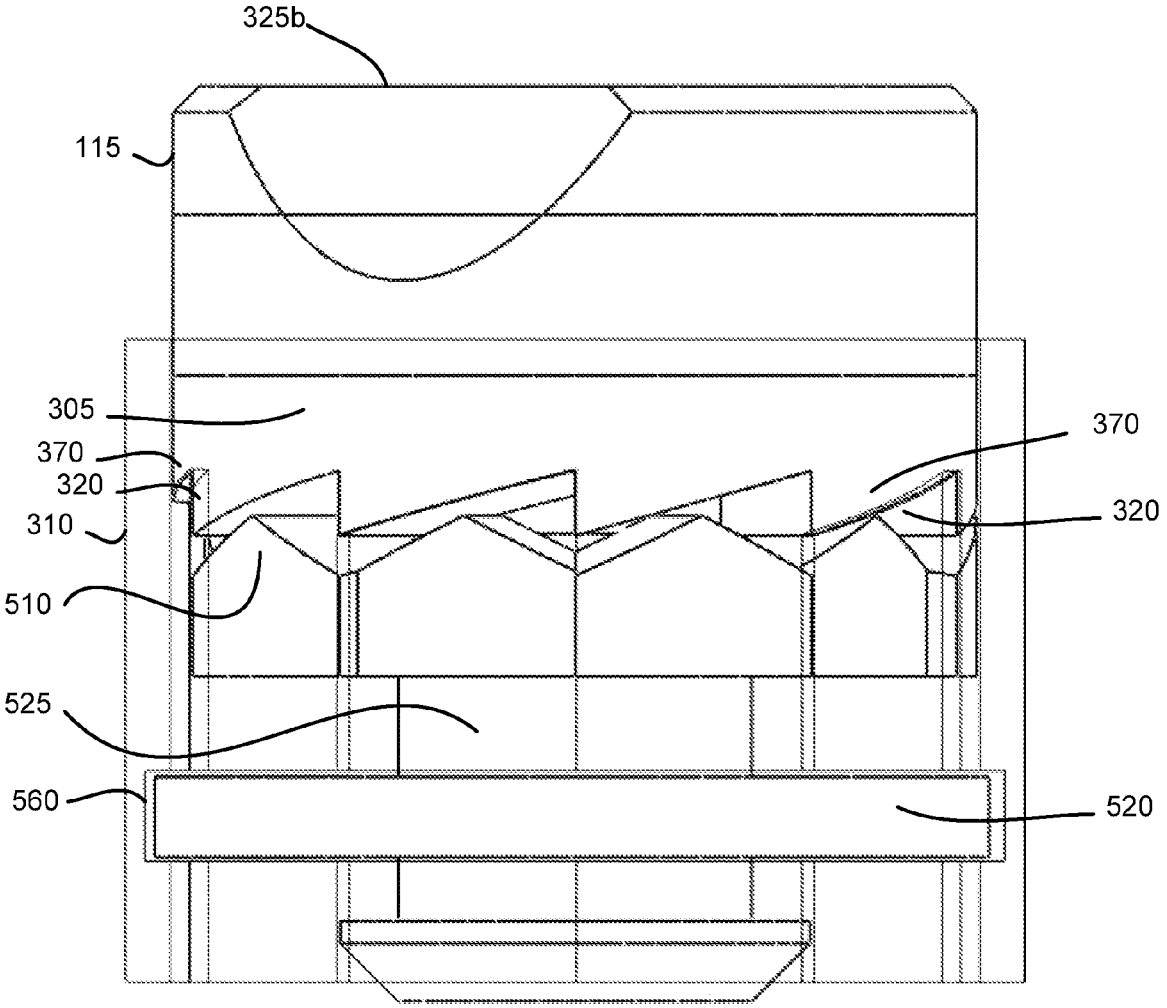
FIG. 13 is a side-view hidden-line drawing illustrating one embodiment of a recompressed indexing cutter apparatus.

FIG. 13 is a side-view hidden-line drawing illustrating one embodiment of a recompressed indexing cutter apparatus 500. The apparatus 500 may be the apparatus 500 of FIG. 12 with the compressive load reapplied as a second compressive load. The description of the apparatus 500 refers to elements of FIGS. 1-12, like numbers referring to like elements. With the reapplication of the compressive load, the sloped face 575 may slide along the protrusion 320 as the cutter 115 is pushed toward the housing 310 by the compressive load, generating a moment that rotates the indexing cog 305 and the cutter 115 about the central axis 335 into the second index position 330. The protrusion 320 and at least one indexing cog tooth 570 may prevent further rotation of the indexing cog 305 and the cutter 115 about the central axis 335 when the indexing cog 305 is interlocked in the second index position 325*b* while the compressive load is applied to the cutter 115.

Figure 14:
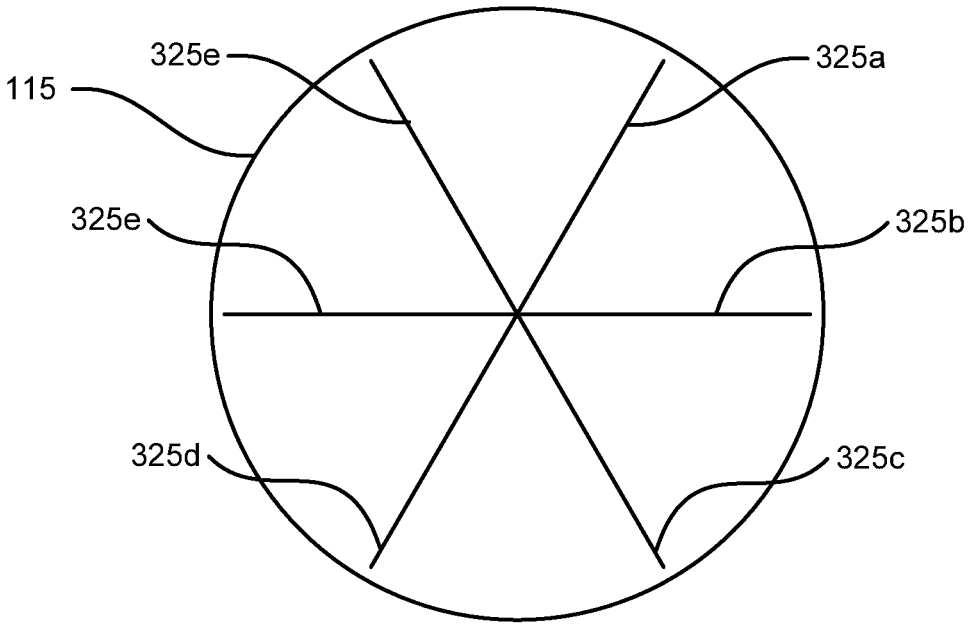
FIG. 14 is a top-view drawing illustrating index positions of the cutter.

FIG. 14 is a top-view drawing illustrating index positions 325 of the cutter 115. The description of the index positions 325 refers to elements of FIGS. 1-14, like numbers referring to like elements. The depicted embodiment shows six index positions for the cutter 115. In one embodiment, the cutter 115 may be positioned in one index position 325 of plurality of index positions 325, the number of the plurality of index positions 325 in the range of 2 to 32 index positions 325. Alternatively, the number of plurality of index positions 325 may be in the range of 4 to 8 index positions 325. In a certain embodiment, the number of the plurality index positions 325 is in the range of 6 to 8 index positions 325. Alternatively, the number of the plurality of index positions 325 is in the range of 4 to 6 index positions 325.

Figure 15:
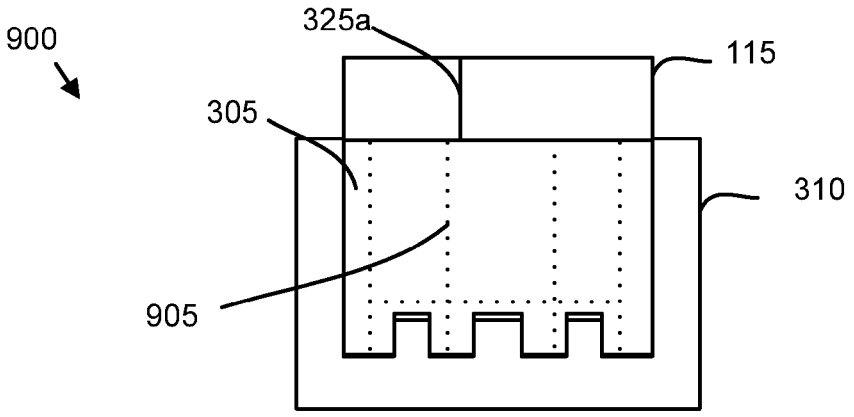
FIG. 15 is a side-view hidden-line drawing illustrating one alternate embodiment of a compressed indexing cutter apparatus.

FIG. 15 is a side-view drawing illustrating one alternate embodiment of a compressed indexing cutter apparatus 900. The apparatus 900 may be an alternate species of the apparatus 200 of FIGS. 3-5. The description of the apparatus 900 refers to elements of FIGS. 1-14, like numbers referring to like elements.

The indexing cog 305 is shown interlocked with protrusions 320 of the housing 310 in response to the compressive load. The indexing cog 305 is positioned in the first indexing position 325*a*. A first spring 905 applies a force to separate the indexing cog 305 and the housing 310, but in the depicted embodiment, the force of the first spring 905 is insufficient to disengage the indexing cog 305 from the housing 310.

Figure 16:
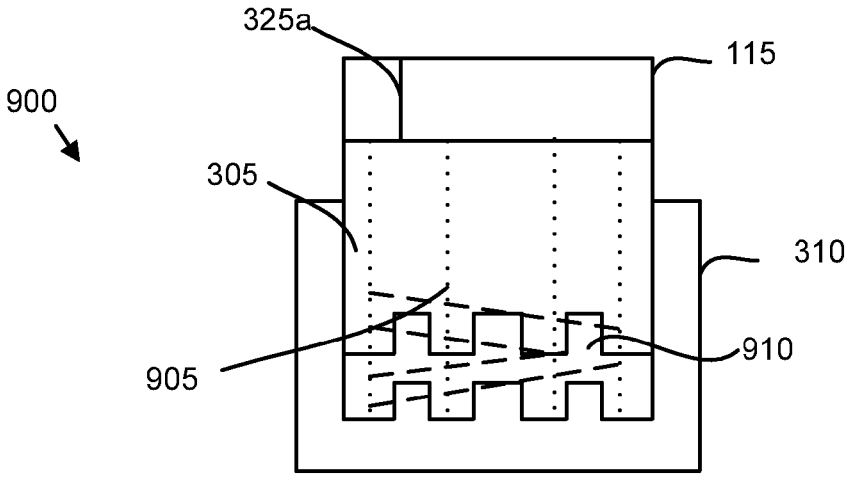
FIG. 16 is a side-view hidden-line drawing illustrating one alternate embodiment of an uncompressed indexing cutter apparatus.

FIG. 16 is a side-view drawing illustrating one alternate embodiment of an uncompressed indexing cutter apparatus 900. The apparatus 900 is the apparatus 900 of FIG. 15 when the compressive load is removed from the cutter 115. The description of the apparatus 900 refers to elements of FIGS. 1-15, like numbers referring to like elements.

In one embodiment, the first spring 905 applies a force that disengages the indexing cog 305 from the housing 310. In a certain embodiment, a second spring 910 applies a moment about the central axis 335 to rotate the indexing cog 305 to the initial second index position 330*b* as will be described hereafter in the description of FIG. 17.

Figure 17:
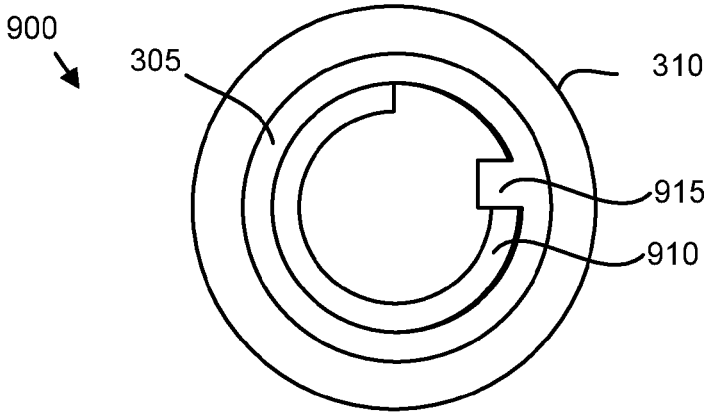
FIG. 17 is a top-view drawing illustrating one alternate embodiment of a motivator spring.

FIG. 17 is a top-view drawing illustrating one alternate embodiment of the second spring 910 of FIG. 16 within the housing 310. The description of the apparatus 900 refers to elements of FIGS. 1-16, like numbers referring to like elements. The second spring 910 may apply a force to a knob 915 of the indexing cog 305, generating a moment about the central axis 335.

Figure 18:
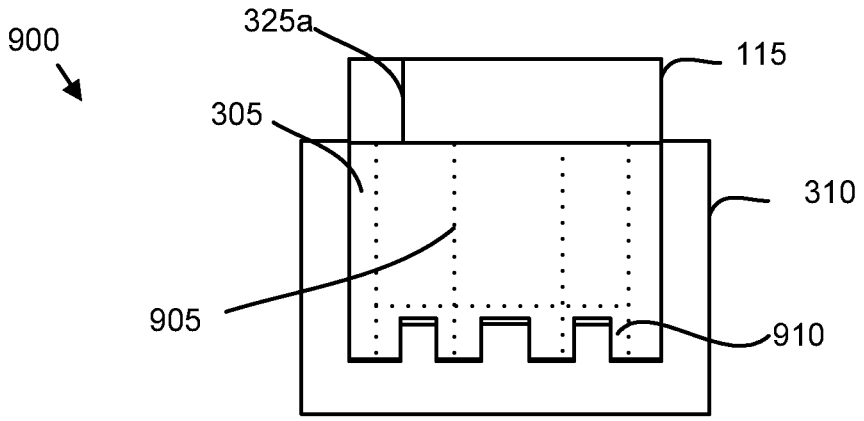
FIG. 18 is a side-view hidden-line drawing illustrating one alternate embodiment of a recompressed indexing cutter apparatus.

FIG. 18 is a side-view drawing illustrating one alternate embodiment of a recompressed indexing cutter apparatus 900. The apparatus 900 is the apparatus 900 of FIG. 16 when the compressive load is reapplied as a second compressive load to the cutter 115. The description of the apparatus 900 refers to elements of FIGS. 1-17, like numbers referring to like elements. The second compressive force pushes the indexing cog 305 to interlock with the housing 310 in the second index position 325*b*.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a housing located in a drill bit;

an indexing cog in physical communication with a cutter and interlocking with the housing in a first index position of a plurality of index positions in response to a first compressive load applied to a surface of the cutter that is located external to the housing and in a direction substantially along rotational axis of the cutter;

and a motivator configured to disengage the indexing cog from the housing and position the indexing cog to interlock with the housing at an initial second index position in response to a removal of the compressive load from the cutter.

2. The apparatus of claim 1, the indexing cog interlocking with the housing in a second index position of the plurality of index positions in response to a second compressive load applied to the cutter.

3. The apparatus of claim 2, the indexing cog comprising a plurality of indexing cog teeth that interlock with at least one protrusion of the housing in the plurality of index positions.

4. The apparatus of claim 3, wherein each indexing cog tooth comprises a sloped face and a vertical face.

5. The apparatus of claim 4, wherein the motivator comprises a push cog, the push cog comprising at least one push cog tooth, and wherein the motivator disengaging the indexing cog comprises the at least one push cog tooth pushing against the sloped face of at least one first indexing cog tooth to move the indexing cog parallel to rotational axis and rotate the indexing cog about the rotational axis from the first index position to the initial second index position.

6. The apparatus of claim 5, wherein the second compressive load moves the sloped face of at least one second indexing cog tooth to physically communicate with the at least one protrusion of the housing, the at least one second indexing cog tooth sliding along the at least one protrusion from the initial second index position to interlock the indexing cog with the housing in the second index position in response to the second compressive load.

7. The apparatus of claim 1, wherein the plurality of index positions are in the range of 2 to 32.

8. The apparatus of claim 1, wherein the plurality of index positions are in the range of 4 to 8.

9. an apparatus comprising:

a housing disposed in a drill bit;

an indexing cog in physical communication with a cutter and interlocking with the housing in a first index position of a plurality of index positions in response to a first compressive lod applied to the cutter;

and a motivator to disengage the indexing cog from the housing and position the indexing cog to interlock with the housing at an initial second index position in response to a removal of the compressive load from the cutter, wherein the motivator comprises a fist spring that applies a force to the indexing cog along a central axis and a second spring that applies a moment to the indexing cog about a central axis.

10. A method for cutter indexing, the method comprising:

placing a cutter in physical communication with an indexing cog;

applying a first compressive load to an external surface of the cutter in a direction substantially along a rotational axis of the cutter;

interlocking the indexing cog with a housing in a first index position of a plurality of index positions in response to the first compressive load, wherein the housing is located in a drill bit;

disengaging the indexing cog from the housing; and positioning the indexing cog to interlock with the housing at an initial second index position in response to a removal of the compressive load from the cutter.

11. The method of claim 10, the method further comprising interlocking the indexing cog with the housing in a second index position of the plurality of index positions in response to a second compressive load applied to the cutter.

12. The method of claim 11, the indexing cog comprising a plurality of indexing cog teeth that interlock with at least one protrusion of the housing in the plurality of index positions.

13. The method of claim 12, wherein each indexing cog tooth comprises a sloped face and a vertical face.

14. The method of claim 13, wherein disengaging the indexing cog comprises the at least one push cog tooth of a push cog pushing against the sloped face of at least one first indexing cog tooth to move the indexing cog parallel to the rotational axis and rotate the indexing cog about the rotational axis from the first index position to the initial second index position.

15. The method of claim 14, wherein the second compressive load moves the sloped face of at least one second indexing cog tooth to physically communicate with the at least one protrusion of the housing, the at least one second indexing cog tooth sliding along the at least one protrusion from the initial second index position to interlock the indexing cog with the housing in the second index position in response to the second compressive load.

16. A system comprising:

a drill bit;

a housing association with the drill bit;

an indexing cog in physical communication with a cutter and interlocking with the housing in a first index position of a plurality of index positions in response to a first compressive load applied to a surface of the cutter that is located external to the housing and in a direction substantially along a rotational axis of the cutter;

a motivator configured to disengage the indexing cog from the housing and position the indexing cog to interlock with the housing at an initial second index position in response to a removal of the compressive load from the cutter.

17. The system of claim 16, the indexing cog interlocking with the housing in a second index position of the plurality of index positions in response to a second compressive load applied to the cutter.

18. The system of claim 16, wherein the cutter is both axially displaced along the rotational axis and rotated about the rotational axis as the indexing cog is disengaged from the housing to interlock with the housing at the initial second index position.

19. The apparatus of claim 1, wherein the cutter is both axially displaced along the rotational axis and rotated about the rotational axis as the indexing cog is disengaged from the housing to interlock with the housing at the initial second index position.

20. The method of claim 10, wherein disengaging the indexing cog from the housing includes axially displacing the cutter and indexing cog along the rotational axis, and wherein positioning the indexing cog to interlock with the housing at an initial second index position includes rotating the cutter and indexing cog about the rotational axis.

* * * * *